US006702004B2

(12) United States Patent
Stratman et al.

(10) Patent No.: US 6,702,004 B2
(45) Date of Patent: Mar. 9, 2004

(54) HEAT EXCHANGE METHOD AND APPARATUS

(75) Inventors: Jason Stratman, Lee's Summit, MO (US); Jidong Yang, Overland Park, KS (US)

(73) Assignee: Marley Cooling Technologies, Inc., Overland Park, KS (US)

( * ) Notice: Subject to any disclaimer, the term of this patent is extended or adjusted under 35 U.S.C. 154(b) by 6 days.

(21) Appl. No.: 10/120,449

(22) Filed: Apr. 12, 2002

(65) Prior Publication Data

US 2003/0192679 A1 Oct. 16, 2003

(51) Int. Cl.[7] ..... A23C 3/04

(52) U.S. Cl. ..... 165/115; 165/170; 165/177; 165/117; 261/153

(58) Field of Search ..... 165/170, 113, 165/115, 117, 177; 62/305, 310; 261/153–156, 158

(56) References Cited

U.S. PATENT DOCUMENTS 3,050,959 A * 8/1962 Rich ..... 165/170
3,290,025 A * 12/1966 Engalitceff, Jr. ..... 165/170
4,102,152 A * 7/1978 Covault ..... 62/428
4,196,157 A 4/1980 Schinner ..... 261/155
4,366,106 A * 12/1982 Benyak et al. ..... 165/178
4,544,513 A * 10/1985 Otterbein ..... 261/153
4,693,302 A 9/1987 Dodds ..... 165/46
5,178,124 A * 1/1993 Lu et al. ..... 165/170
5,636,527 A * 6/1997 Christensen et al. ..... 165/170

FOREIGN PATENT DOCUMENTS

EP 0 961 092 1/1999

* cited by examiner

*Primary Examiner*—Terrell McKinnon
(74) *Attorney, Agent, or Firm*—Baker & Hostetler LLP

(57) ABSTRACT

An apparatus for use in a counter flow heat exchange assembly that provides increased heat exchange. The apparatus includes a plurality of adjacently spaced arrays, each array having a plurality of cooling conduits that are connected to one another through the utilization of connector portions. The adjacent vertical arrays have a centerline-to-centerline distance extending between them that is greater than the diameter of each of the conduits employed. In addition, the apparatus includes a vertical partition that extends between some or all conduits of each array.

30 Claims, 8 Drawing Sheets

HEAT EXCHANGE METHOD AND APPARATUS

FIELD OF THE INVENTION

The present invention relates to a method and apparatus for the disposal of heat utilizing a heat exchange liquid in combination with a heat exchange gas. More particularly, the present invention relates to an apparatus for providing an evaporative heat exchanger wherein the heat exchanger is employed, for example, to dispose of large quantities of heat generated by various industrial processes.

BACKGROUND OF THE INVENTION

Evaporative heat exchangers are widely used in many applications where it is necessary to cool or condense fluid and/or gas that must be maintained out of contact with the heat exchange medium to which the heat is transferred. For example, air conditioning systems for large buildings employ evaporative heat exchangers for carrying out a portion of the heat exchange that is essential to the cooling process. In these systems, air inside the building is forced passed coils containing a cooled refrigerant gas thereby transferring heat from inside the building into the refrigerant gas. The warmed refrigerant is then piped outside the building where the excess heat must be removed from the refrigerant so that the refrigerant gas can be re-cooled and the cooling process continued. In addition, industrial processes such as chemical production, metals production, plastics production, food processing, electricity generation, etc., generate heat that must be dissipated and/or disposed of, often by the use evaporative heat exchangers. In all of the foregoing processes and numerous other processes that require the step of dissipating or disposing of heat, evaporative heat exchangers have been employed.

The general principle of the evaporative heat exchange process involves the fluid or gas from which heat is to be extracted flowing through tubes or conduits having an exterior surface that is continuously wetted with an evaporative liquid, usually water. Air is circulated over the wet tubes to promote evaporation of the water and the heat of vaporization necessary for evaporation of the water is supplied from the fluid or gas within the tubes resulting in heat extraction. The portion of the cooling water which is not evaporated is recirculated and losses of fluid due to evaporation are replenished.

Conventional evaporative heat exchangers are presently in widespread use in such areas as factory complexes, chemical processing plants, hospitals, apartment and/or condominium complexes, warehouses and electric generating stations. These heat exchangers usually include an upwardly extending frame structure supporting an array of tubes which form a coil assembly. An air passage is formed by the support structure within which the coil assembly is disposed. A spray section is provided usually above the coil assembly to spray water down over the individual tubes of the coil assembly. A fan is arranged to blow air into the air passage near the bottom thereof and up between the tubes in a counter flow relationship to the downwardly flowing spray water. Heat from the fluid or gas passing through the coil assembly tubes is transferred through the tube walls to the water sprayed over the tubes. As the flowing air contacts the spray water on the tubes, partial evaporation of some of the spray water occurs along with a transfer of heat from the spray water to the air. The air then proceeds to flow out of the heat exchanger system. The remaining unevaporated spray water collects at the bottom of the conduit and is pumped back up and out through the spray section in a recirculatory fashion.

Current practice for improving the above described heat transfer process includes increasing the surface area of the heat exchange tubes. This can be accomplished by increasing the number of coil assembly tubes employed in the evaporative heat exchanger by "packing" the tubes into a tight an array as possible, maximizing the tubular surface available for heat transfer. The tightly packed coils also increase the velocity of the air flowing between adjacent tube segments. The resulting high relative velocity between the air and water promotes evaporation and thereby enhances heat transfer.

Another practice currently employed to increase heat transfer surface area is the use of closely spaced fins which extend outwardly, in a vertical direction from the surface of the tubes. The fins are usually constructed from a heat conductive material, where they function to conduct heat from the tube surface and offer additional surface area for heat exchange.

In addition, another method currently used to increase heat exchange is the use of splash type fill structures placed between individual tubes in a coil assembly that can function to provide additional water surface area for heat transfer.

These current practices can have drawbacks. For example, the use of additional tubes requires additional coil plan area along with increased fan horsepower needed to move the air through the tightly packed coil assembly, increasing unit cost as well as operating cost. In addition, placement of fins between the individual tubes may make the heat exchanger more susceptible to fouling and particle build up. Further, indiscriminate placement of fill sheets within coils assemblies can cause performance degradation by hindering air flow, and the fill sheets can act as an insulator where they abut the tubes, and/or can cause heat already transferred to the air to be transferred back to the cooling water.

Accordingly, it is desirable to provide a method and apparatus for effectuating desirable, evaporative heat exchange that can offer a substantial reduction in parts, improved efficiency and or reduction of complex and costly assembly of components. It is also desirable to provide increased evaporative heat exchange without undesirably increasing the size of the unit, the manufacturing cost of the unit, and/or operating cost of the unit.

SUMMARY OF THE INVENTION

The foregoing needs are met, at least in part, by the present invention where, in one embodiment, an evaporative apparatus for use in a counter flow heat exchange assembly is provided having a plurality of generally vertical arrays adjacently spaced laterally to each other. Each of the individual arrays includes a plurality of generally horizontal conduits extending across the heat exchange assembly in spaced relation to each other at different vertical levels of the counter flow heat exchange assembly. The arrays additionally have connector portions that connect the vertically adjacent conduits to each other. The evaporative apparatus also includes a plurality of generally vertical partitions each extending between at least some of the conduits in each of the arrays and at least some of the partitions extending between less than all conduits of each of the arrays.

In accordance with another embodiment of the present invention, an evaporative apparatus for use in a counter flow heat exchange is provided having a means for exchanging heat from a substance to be cooled having a first height, and a means for spraying a cooling fluid onto the heat exchanging means. The evaporative apparatus additionally has a means for passing air over the heat exchanging means along with a means for partitioning the cooling fluid and the air. The partitioning means includes a plurality of generally vertical partitions each having a second height less than the first height of the heat exchanging means.

In accordance with yet another embodiment of the invention, an evaporative apparatus for use in a counter flow heat exchange assembly is provided having a plurality of generally vertical arrays adjacently spaced laterally to each other. The arrays are each arranged along respective generally vertical centerlines and include a plurality of generally horizontal conduits. The arrays each have a diameter and extend across the heat exchange assembly in spaced relation to each other at different vertical levels of the counter flow heat exchange assembly. The arrays have connector portions for connecting vertically adjacent conduits to each other, and the adjacent vertical arrays have a centerline-to-centerline distance therebetween that is greater than the diameter of each the conduits. The arrays additionally include a plurality of generally vertical partitions each extending between at least some conduits of each array.

In yet another embodiment of the present invention, an evaporative apparatus for use in a counter flow heat exchange assembly having a means for exchanging heat from a substance to be cooled, wherein the means includes a plurality of arrays of conduits is provided. The arrays have a first diameter and are spaced by a centerline to centerline distance between the conduits. In addition, the evaporative apparatus has a means for spraying a cooling fluid onto the heat exchanging means along with a means for passing air over the heat exchanging means. The evaporative apparatus also includes a means for partitioning the cooling fluid and the air and a means for spacing adjacent arrays such that they have a centerline to centerline distance therebetween that is greater than the first diameter of the conduits.

In accordance with yet a further embodiment of the invention, a partition for a heat exchanging apparatus having conduits in generally vertical arrays, is provided. The partition includes a plurality of saddle portions for engaging the conduits and a plurality of dimple portions for engaging the conduits. The saddle portions and dimple portion additionally provide spacing between laterally adjacent vertical arrays, wherein the saddle portions and the dimple portions are positioned in staggered vertical levels with respect to one another on opposed sides of the ribs. The partition additionally has a plurality of horizontal channels where portions of the partition have been removed. The channels are vertically spaced apart from one another and extend horizontally between said saddles.

In another aspect of the invention, a method is provided for heat exchange comprising the steps of: providing a heat exchange assembly having a plurality of generally vertical arrays adjacently spaced laterally to each other, the arrays each comprising a plurality of generally horizontal conduits extending across the heat exchange assembly in spaced relation to each other at different vertical levels of the heat exchange assembly, each array having connector portions that connect vertically adjacent conduits to each other; providing a plurality of generally vertical partitions each extending between at least some of the conduits in each of the arrays and between less than all conduits of each of the arrays; flowing a substance to be cooled through the conduits; spraying a fluid onto the partitions and the conduits; and passing air over the partitions and the conduits.

In yet another aspect of the present invention, a method for exchanging heat is provided comprising the steps of: exchanging heat from a substance to be cooled that passes through a plurality of conduits; spraying a cooling fluid onto the conduits; passing air over the conduits; and partitioning the cooling fluid and the air flow via at least one partition having a plurality of generally vertical partitions each having a second height less than the first height of the heat exchanging means.

In accordance with yet another aspect of the present invention, a method for exchanging heat is provided comprising the steps of: providing a heat exchange assembly having a plurality of generally vertical arrays adjacently spaced laterally to each other, the arrays each arranged along a respective, generally vertical centerline and the arrays each comprising a plurality of generally horizontal conduits extending across the heat exchange assembly in spaced relation to each other at different vertical levels of the heat exchange assembly, each array having connector portions for connecting vertically adjacent conduits to each other; providing a plurality of generally vertical partitions each extending between at least some conduits of each array, and adjacent ones of the vertical arrays have a centerline-to-centerline distance therebetween that is greater than the diameter of each said conduit; flowing a substance to be cooled through the conduits; spraying a fluid onto the vertical partitions and outer surfaces of the conduits; and passing air over the individual conduits.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
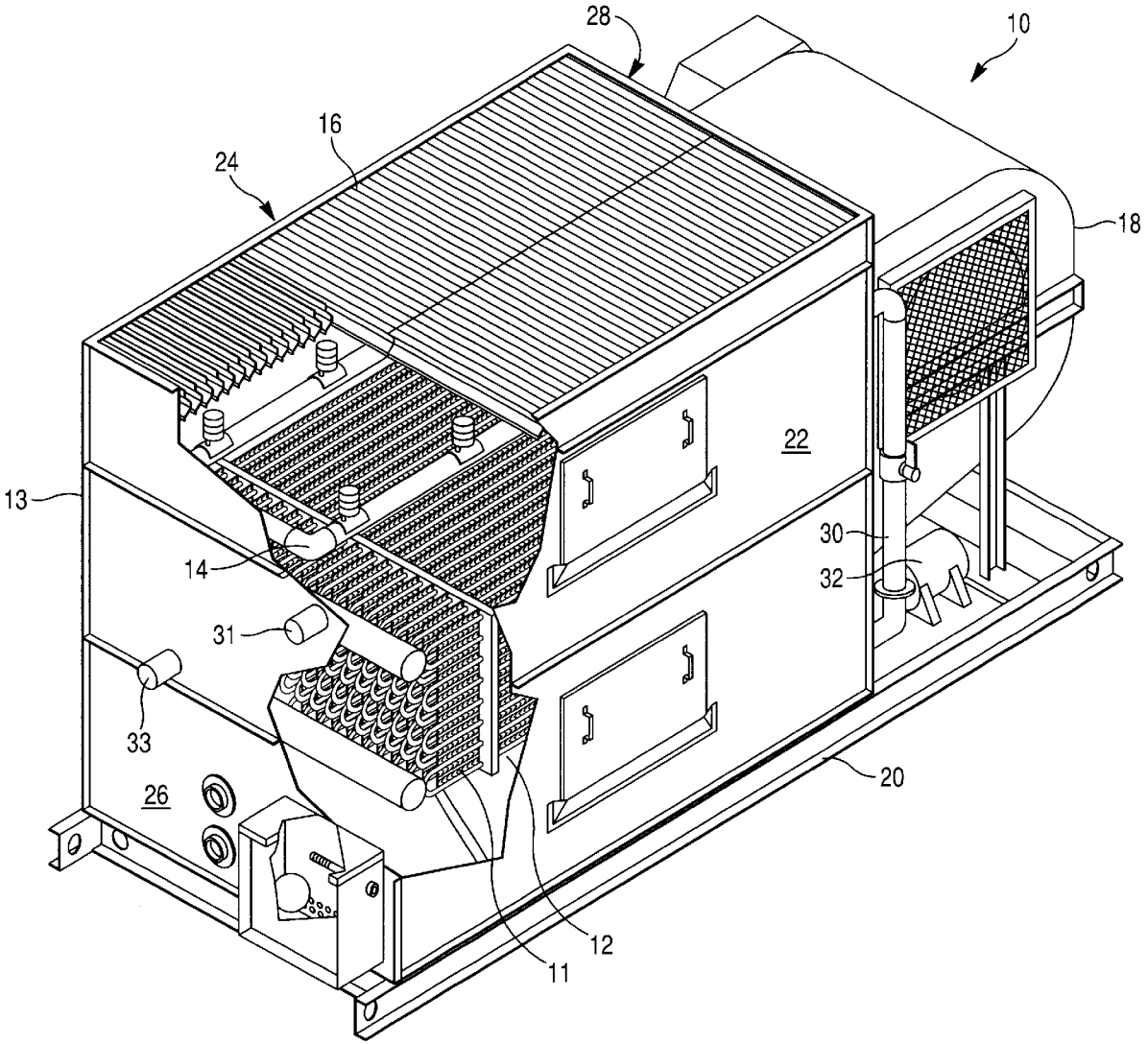
FIG. 1 is a cutaway isometric view of an evaporative heat exchanger employing a heat exchange coil circuit in accordance with an embodiment of the present invention.

Referring now to the figures wherein like reference numerals indicate like elements, FIGS. 1–9 illustrate presently preferred embodiments of a evaporative heat exchanger apparatus. While in the embodiments depicted the exchanger is a counter flow heat exchanger, it should be understood that the present invention is not limited in its application to heat transfer.

Referring now to FIG. 1, a counter flow evaporative heat exchanger apparatus, generally designated 10, is illustrated. The exchanger apparatus 10 includes a coil assembly 11 having a plurality of coil arrays 12, a generally vertical air passage 13, a cooling fluid spray assembly 14, and upper mist eliminators 16, a cooling air current generator employing a fan unit 18, and a base 20 having a lower fluid collection basin therein. More particularly, the vertical passage 13 is of generally rectangular, uniform cross-section and includes vertical front and rear walls 22, 24 and vertical side walls 26, 28. The walls 22, 24, 26, 28, extend upwardly from the base 20 and confine the mist eliminators 16 which extends across substantially the entire cross section of the vertical air passage 13. The side walls 22, 24 and front and rear walls 26, 28 combine to form an interior within which the air passage 13, the cooling fluid spray assembly 14, and the coil assembly 11 are located. The cooling air current generator 18 is preferably positioned adjacent side wall 28.

The walls and other structural elements that form vertical passage 13 are preferably formed from mill galvanized steel, but may be composed of other suitable materials such as stainless steel, hot dipped galvanized steel, epoxy coated steel, and/or fiber reinforced plastics (FRP). The fan unit 18 of the air current generator has an outlet cowl which projects through the side wall 28 and into the air passage 13 preferably above the base 20 and the collection basin therein.

As shown in FIG. 1, a recirculation line 30 is located on the side wall 28 and extends between a first and second recirculation port (not pictured) and a recirculation pump 32. The lower port extends through the wall 28 and into the collection basin located in the base 20. The recirculation line 30 extends from the lower port to the pump 30 and to the upper port, returning the cooling fluid to the spray assembly 14.

The cooling fluid spray assembly 14 includes a plurality of pipes and nozzles positioned directly above the coil assembly 11 for distribution of a cooling liquid, preferably water, onto the individual coil arrays 12 of the coil assembly 11. The water is supplied to the coil assembly 11 by way of the recirculation line 30 previously described and enters the spray assembly 14.

The mist eliminator 16 generally includes a multitude of closely spaced, elongated strips that are canted along their length and forms an opening through the top of the conduit 10 for the air currents to exit.

Referring now particularly to FIGS. 1–7, the coil assembly 11 includes a plurality of the individual vertical coil arrays 12. The coil assembly 11 has an upper inlet manifold 31 for distributing the fluid to be cooled or condensed to the various coil arrays 12 along with a lower outlet manifold 33 for returning cooling fluid from the coil arrays 12 to the process in which it is used.

As can be observed specifically in FIGS. 2–6, each coil array 12 is preferably in the form of a cooling tube 35 bent into a plurality of generally horizontal conduits 36. Each horizontal conduit 36 is connected to its counterparts above and/or below in the array by way of u-bend portions 37. Each array 12 carrys fluid from the upper manifold to the lower manifold. The u-bends 37 and horizontal conduits 36 preferably form a serpentine arrangement for each array having 180 degree bends near each of the side walls 26, 28. The aforementioned arrangement results in each array extending generally horizontally across the interior of the air passage 13 in a back and forth orientation at different levels along a vertical plane. Each array is parallel to additional, laterally spaced adjacent arrays 12 that make up the coil assembly 11. A fill sheet portion 38 extends vertically between designated horizontal conduits 36 of the coil circuit 12 and provides a partition for the air passage 13.

The conduits 36 are preferably formed from copper alloy, however other materials suitable for conducting heat energy such as aluminum, steel and/or stainless steel derivatives may be utilized. As depicted, the conduits 36 are cylindrical in shape, however the tubes may vary in shape for example, square, oval, or rectangular. In addition, the cooling tubes 35 may vary in diameter. Although unitary tubes 35 are preferred, the horizontal conduits 36 may be individual tubes with a connector at each end providing fluid connection between vertically adjacent conduits. Also, the conduits 36 are preferably generally parallel to one another and generally horizontal. References to parallel and/or horizontal in this application refer to generally or substantially parallel and do not indicate any particular degree of the same.

As depicted in FIGS. 2–6, the fill sheet 38 extends vertically between vertically adjacent horizontal conduits 36 of an individual coil array 12. The fill sheet 38 is preferably one continuous piece that runs generally parallel with the coil array 12 along the centerline of the conduits 36. At the conduits 36, the fill sheet 38 runs peripherally around one side of the conduit 36 via saddles 42 and dimples 44 described in more detail below. The fill sheet 38 is preferably a textured relatively thin sheet formed from polyvinyl chloride (PVC) or light metallic material. The sheet 38 is preferably about 1.5% to 3.5% of the cooling tube diameter, however sheets having more or less thickness may be employed. In addition, the sheet 38 has diagnonally corrugated areas 39 with a peak-to-peak corrugation that preferably ranges from about 25% of the cooling tube diameter to about 75% of the cooling tube diameter. The sheet 38 also includes vertical support ribs 40 that provide strength and support to the sheet 38 along with supporting the conduits 36 via the saddles 42 and dimples 44. The saddles 42 are disposed on one side of each rib 40 and dimples 44 on the opposite side.

Figure 2:
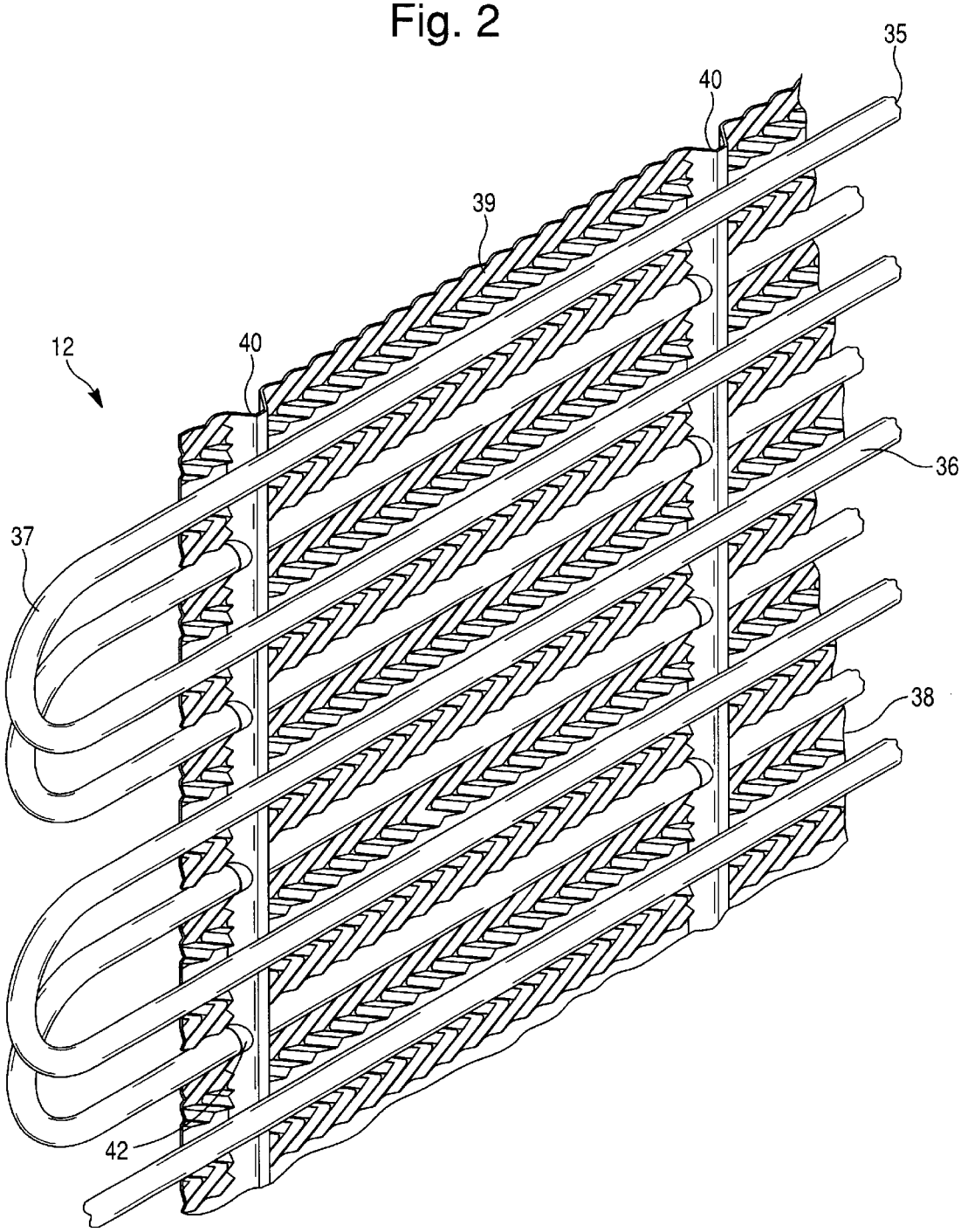
FIG. 2 is a perspective view showing of two coil arrays and a single partition in accordance with an embodiment of the present invention.
Figure 3:
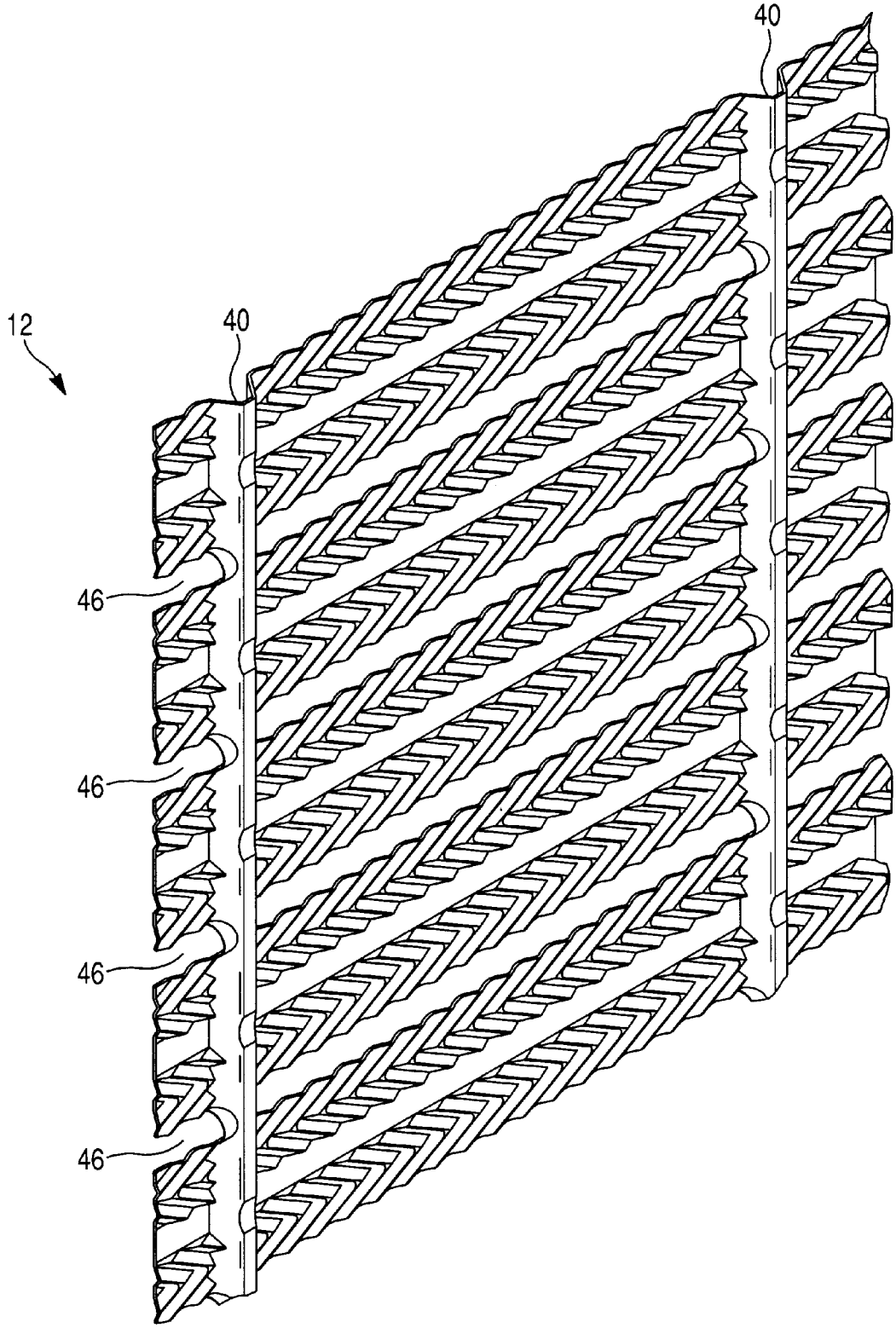
FIG. 3 is a front view of the partition depicted in FIG. 2 with the coil array removed, showing horizontal channels in accordance with an embodiment of the invention.
Figure 4:
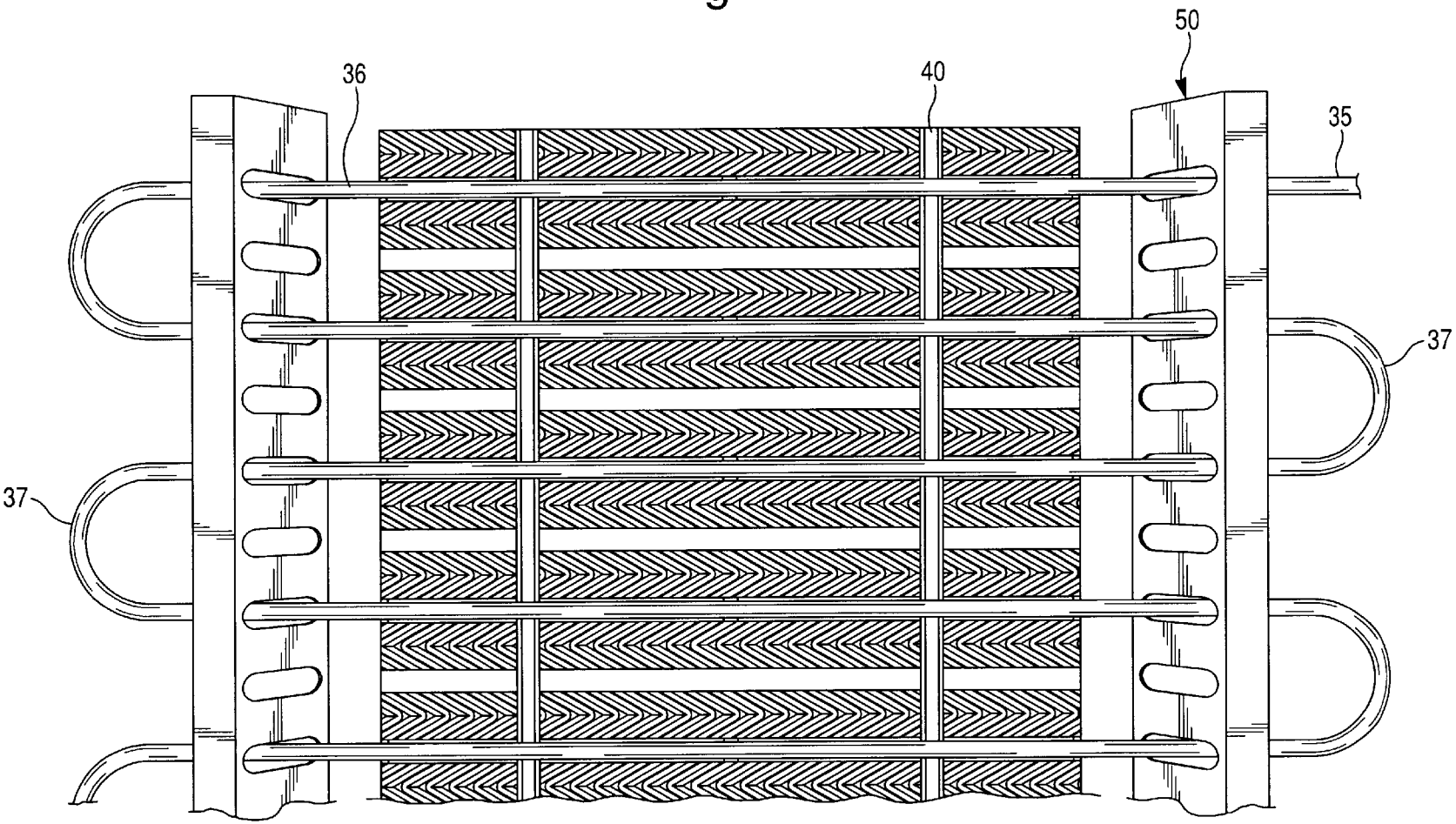
FIG. 4 is a front view showing one coil array and one partition as depicted in FIG. 1 disposed on a support structure for an evaporative heat exchanger.
Figure 5:
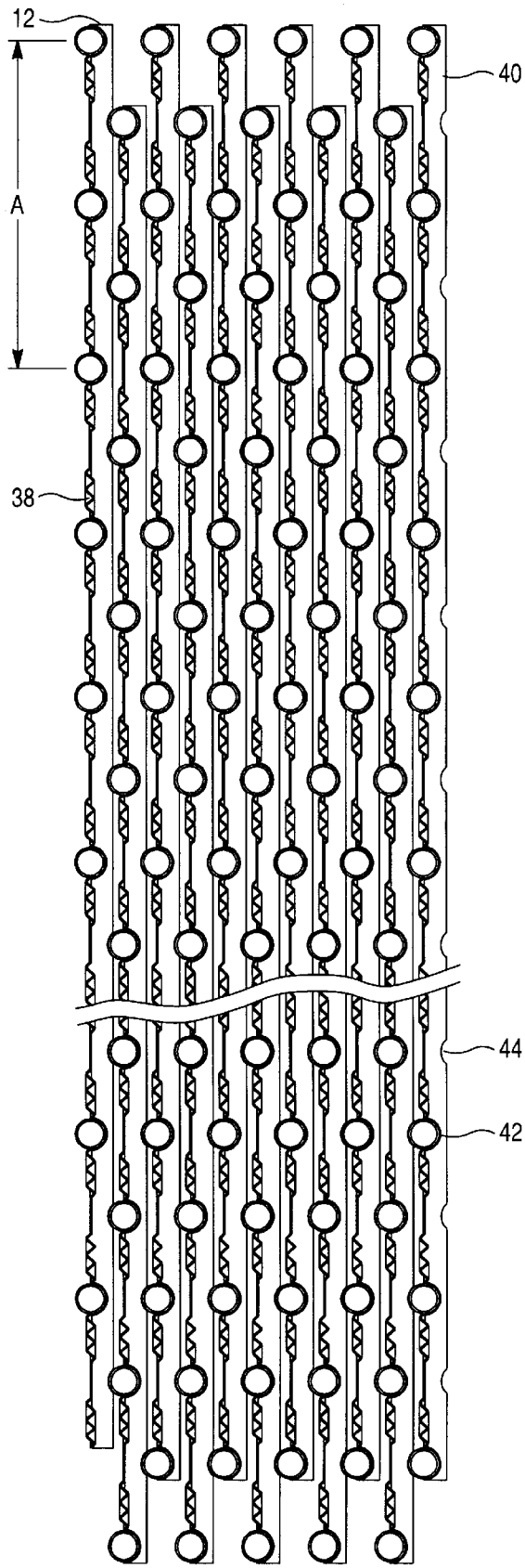
FIG. 5 is a cross-sectional view of one embodiment showing a plurality of coil arrays and partitions.

As can be viewed in FIGS. 2–6, the saddles 42 and dimples 44 are arranged at different levels or elevations, in an alternating, offset fashion. The ribs 40 provide both elevational spacing between horizontal conduits 36 within a single array 12 and adjacent spacing between laterally neighboring arrays 12. The sheet 38 includes horizontal channels 46 where portions of the fill sheet are removed. The conduits 36 are disposed in the channels 46. These channels 46 are preferably aligned with the saddles 42 of the fill sheet 38. As depicted in FIGS. 4 and 5, the vertical staggering between conduits 36 of neighboring coil arrays 12, orients the conduits 36 so that conduits at one level of an individual array 12 are essentially rationally centered between conduits 36 of a neighboring array 12 at the next higher and next lower level.

FIG. 4 illustrates a support structure 50 that provides vertical support of the conduits 36.

Figure 7:
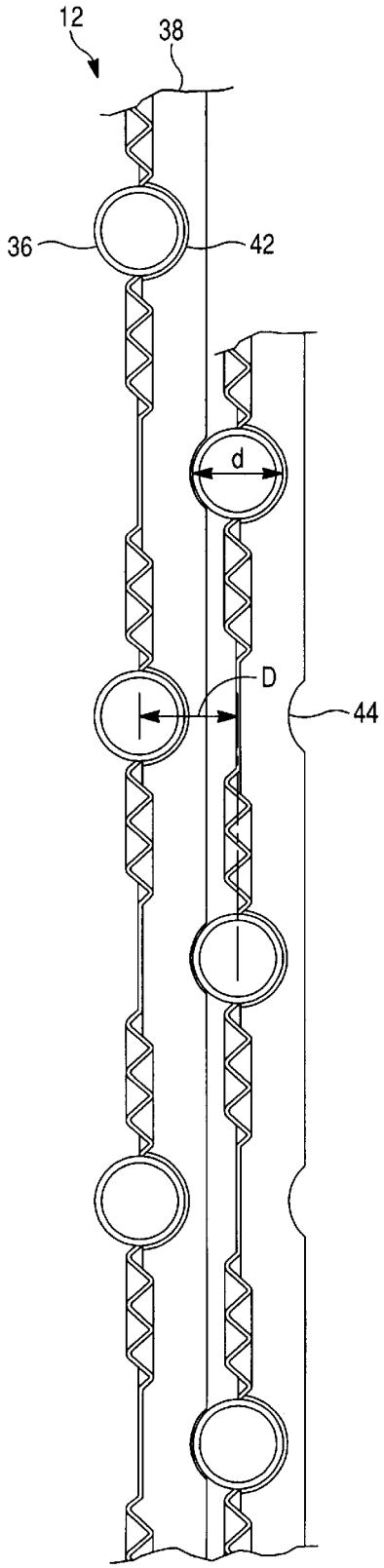
FIG. 7 is a schematic end view of two coil arrays and partitions illustrating the spacing of laterally adjacent coil arrays.

FIG. 7 illustrates how the saddles 42 retain the conduits 36 and provide elevational spacing between the individual conduits 36 of the an array 12. The saddles 42 preferably have a depth such that when a conduit 36 is retained, the edges of the fill sheet adjacent the conduit 36 are substantially aligned with the centerline of the conduit 36. The spacing between each conduit 36 within a single array 12 is dependent upon the diameter of the conduit being utilized. Thus, conduit diameter is determinative of saddle spacing. Elevational spacing of the conduits 36 from about 200% to 1000% of the diameter of the conduit 36 is preferred. More preferably, this distance is approximately 530% of the diameter of the conduit 36 being employed.

The dimples 44 are further utilized for providing spacing between conduits of separate, laterally neighboring coil arrays 12. As illustrated in FIG. 7, the dimples 44 are preferably curved indentations capable of engaging a portion of a conduits 36 of a neighboring coil circuit 12. The dimples 44 and saddles 42 can be alternatively shaped to engage tubes of varying geometries.

Figure 6:
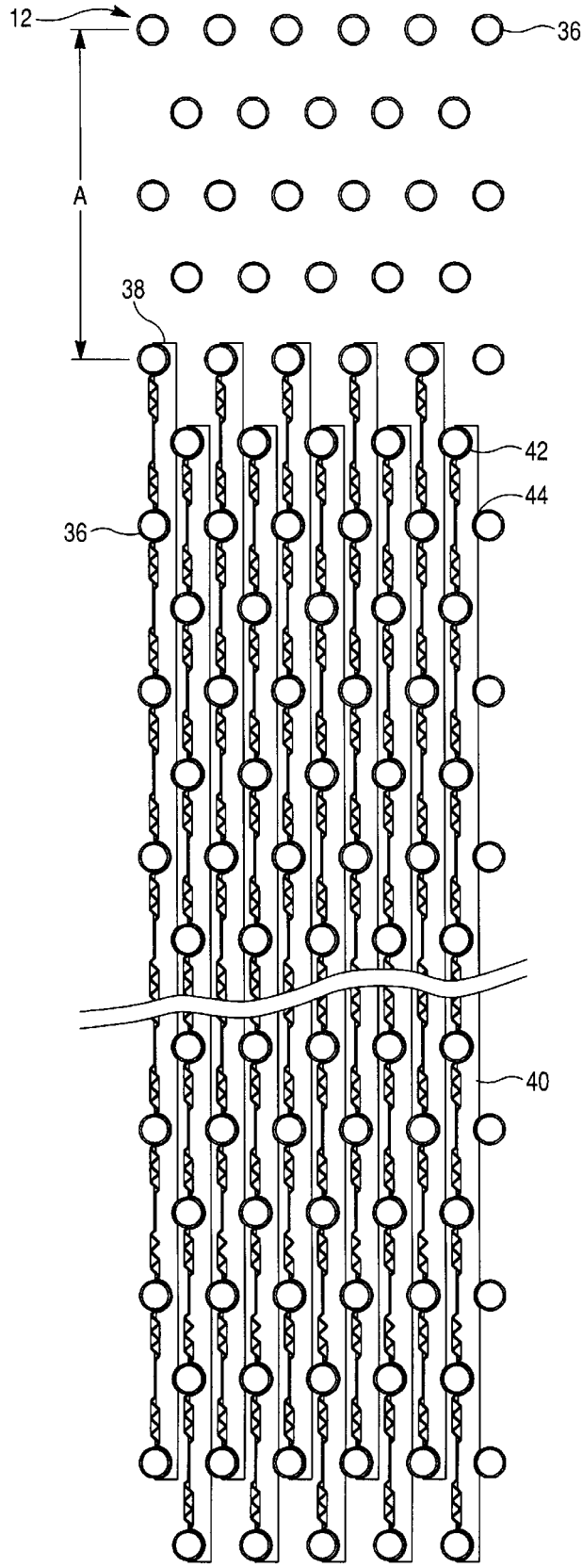
FIG. 6 is a cross-sectional view of another embodiment, showing a plurality of coil arrays and partitions.

The dimples 44 in combination with the ribs 40 provide a spacing distance between conduits of neighboring arrays that is preferably equal to approximately 110% to 150% the diameter of the conduits 36 utilized in the array 12. More preferably, this distance is about 130% the cooling tube diameter. Due to the above described spatial arrangement, a vertical clear line of sight exists through the coil assembly 11. This clear line of sight refers to the fact that two adjacent arrays 12 have a centerline distance (D) greater than the outer diameter (d) of the conduit 36 utilized, as depicted in FIG. 6. The aforementioned spacial relationship creates a vertical channel between the circuits that is free and unobstructed. As a result of this clear sight line, air flow through the coil assembly is not hindered and pressure loss is reduced.

The saddles 42 and dimples 44 combine to provide support to the fill sheets 38 along with providing a mechanism for attaching the sheets to the conduits 36. As a result of the aforementioned utilization of the vertical ribs 40 in combination with saddles 42 and dimples 44, the need for a separate mechanical attaching means to affix the fill sheet to the conduit 36 is eliminated. In addition, the need for attaching the fill sheet 38 to each individual conduit 36 with fixtures at a multitude of places is eliminated.

Referring now to FIGS. 2 and 3, horizontal channels 46 are depicted extending parallel across the width of the fill sheet 38. As previously described, the channels 46 are aligned with the saddles 42 of the ribs 40 and provide a window like opening for the cooling tubes 36. Preferably the edges of the channels 46 do not touch or contact the conduits 36. This orientation is preferred especially in applications where the fill sheets are constructed from materials that are non-conductive, for example plastics and plastic derivatives. These non-conductive materials can often function as insulators when they touch the conduits 36. In addition, these channels 46 allow for the entire surface area of the cooling tube to be exposed to the cooling fluid and air currents, (except in the regions touching the saddles 42 and dimples 44), improving the amount of heat transfer by the individual tubes.

During operation of the evaporative heat exchanger 10, a fluid to be cooled or condensed, such as water or gas, flows into the exchanger 10 via an inlet port. This fluid is then distributed by the upper manifold to the individual arrays 12 that make up the coil assembly 11. The fluid being cooled then proceeds to flow through the various conduits 36, back and forth across the interior of the air passage 13 at different levels therein until it reaches the lower manifold where it is transferred out of the evaporative heat exchanger 10. As the fluid being cooled flows through the coil assembly 11, water is sprayed from the spray assembly 14 onto the fill sheets 38 and conduits 36 of each, separate array 12 while air from the air current generator 18 is blown up between the individual conduit tubes 36. The upwardly flowing air then passes through the mist eliminator 16 and out of the system.

More particularly, during its flow through the conduits 36, the fluid to be cooled gives up heat to the conduit walls of the conduits 36. The heat passes outwardly through the walls to the water flowing over the outer surface of the conduit. Meanwhile the water is simultaneously coming into evaporative contact with the upwardly moving air and the water gives up heat to the air both by normal contact transfer and by partial evaporation.

The present invention improves the aforementioned heat exchange process by increasing the heat exchange capabilities and affording the process to be more efficient. The addition of fill sheets 38 functions to provide increased air-water interface by producing more water surface area that may contact both the conduits 36 and the air currents. The fills sheets 38, in combination with the spacing of the cooling tubes previously described, create clear vertical sight lines through the coil assembly 11. This results in an increased, more efficient heat transfer without requiring increased coil plan area and/or air current generator horsepower. In addition, the fill sheets 38 function to direct water between cooling tubes 36, improving water flow over the entire tube surface, significantly reducing the likelihood of evaporative fouling and/or dry spots on the cooling tube surfaces. Another benefit of placing the fill sheets within the coil circuits is the sheets 38 allow the recirculating spray system to operate at lower flow rates, affording the heat exchange unit to employ pumps that are less expensive to purchase and operate.

Figure 8:
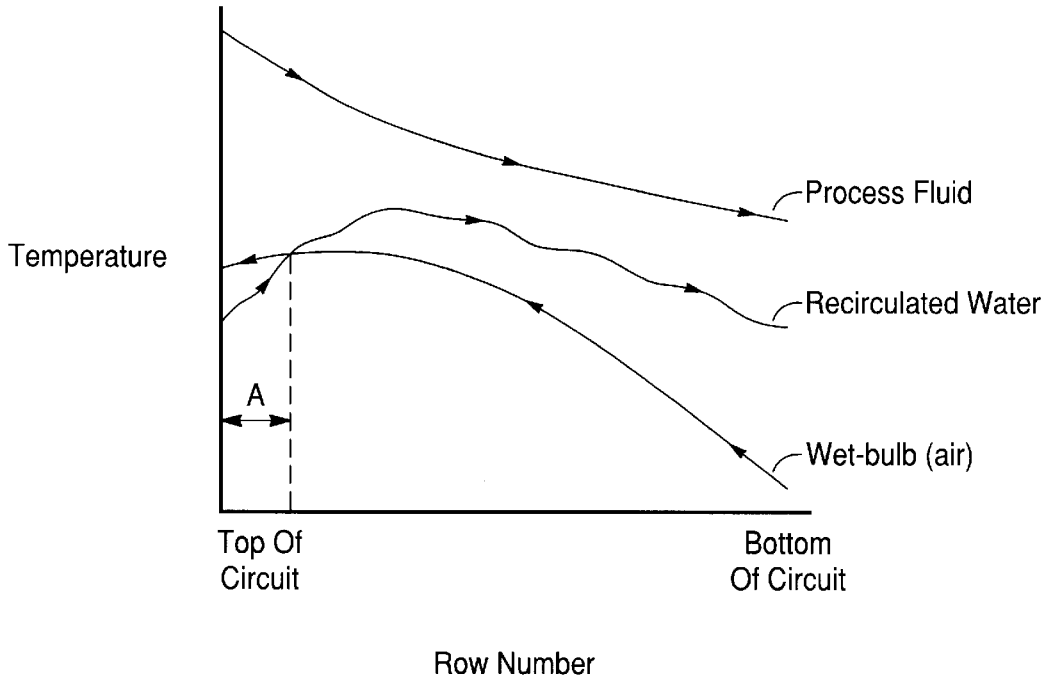
FIG. 8 is a graph of the temperature profile of heat exchange fluids as they pass through a plurality of coil arrays in accordance with an embodiment having a partition between all of the conduits in an array.

As depicted in FIG. 5, the fill sheets 38 are preferably disposed between the conduits 36 in the bottom section and middle of the arrays 12, but not between conduit 36 at the top of the array 12. Referring specifically to FIGS. 7 and 8, the recirculating water temperature is coldest at the top of the exchanger unit 10 while the air wet-bulb temperature is the hottest. As previously described, the fill sheets 38 provide additional water surface area for heat transfer. In FIG. 8, sheets 38 of embodiment FIG. 4 are provided between all conduits 36. The partitions in the lower portions of the coils in embodiments FIGS. 4 and 5 function to lower the recirculating water temperature to a lower temperature differential between the recirculating water temperature and air wet-bulb temperature. This allows the temperature differential between the process fluid and the wet-bulb temperature to be lower than a coil without partitions. In embodiment FIG. 5, the recirculating water temperature is much lower than the effluent wet-bulb temperature of the air in region A. In region A, the recirculating water gains heat from the process fluid and from the air. In region A, transferring heat from the air to the recirculating water lowers the amount of heat that can be transferred from the process fluid to the water. Lowering the amount of heat removed from the process fluid raises the exit process fluid temperature.

Figure 9:
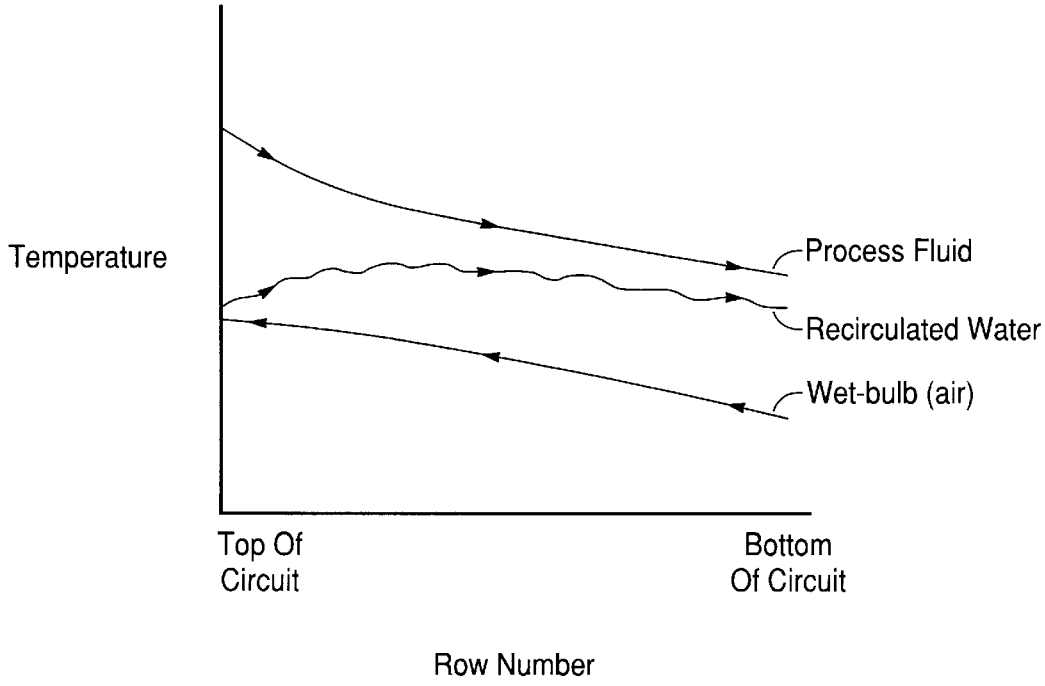
FIG. 9 is a graph of the temperature profile of heat exchange fluids as they pass through a plurality of coil arrays similar to those in FIG. 6 having a partition between less than all of the conduits in an array.

To minimize this effect it is advantageous in some embodiments to employ the fill sheets 38 only between conduits 36 in lower and middle portions of the array 12 so that the sheets 38 do not extend between all vertically adjacent conduits, reducing the likelihood that heat will be transferred back from the air to the recirculating water, making the counter flow heat exchanger less efficient. FIG. 9 shows a graph of the resulting desirable temperatures, corresponding to the embodiment of FIG. 6.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An evaporative apparatus for use in a counter flow heat exchange assembly comprising:

a plurality of generally vertical arrays adjacently spaced laterally to each other, said arrays each arranged along a respective generally vertical centerline and comprising a plurality of generally horizontal conduits each having a diameter and extending across the heat exchange assembly in spaced relation to each other at different vertical levels of the cross flow heat exchange assembly, each said array having connector portions for connecting vertically adjacent conduits to each other, and adjacent ones of said vertical arrays having a centerline-to-centerline distance there between that is greater than the diameter of each said conduit; and a plurality of generally vertical partitions each extending between at least some conduits of each array, wherein at least some of said partition extends between less than all said conduits of each respective said array.

2. The evaporative apparatus according to claim 1, wherein said partitions extend between all said conduits of each said array.

3. The evaporative apparatus according to claim 1, wherein said partitions are positioned substantially along the centerline of said vertical array.

4. The evaporative apparatus according to claim 1, wherein said conduits are formed from a material capable of conducting heat energy.

5. The evaporative apparatus according to claim 4, wherein the conductible material is copper.

6. The evaporative apparatus according to claim 5, wherein the conduits are copper tubing.

7. The evaporative apparatus according to claim 2, wherein said vertical partitions each comprise at least one rib portion.

8. The evaporative apparatus according to claim 7, wherein said partitions each further comprise a plurality of rib portions spaced from one another that extend at least part of the vertical length of said partition.

9. The evaporative apparatus according to claim 1, wherein the connector portions each comprise a U-shaped tube.

10. The evaporative apparatus according to claim 1, wherein the partitions have at least one corrugated region.

11. The evaporative apparatus according to claim 8, wherein said rib portions each further comprise:

a plurality of saddle portions for engaging said conduits;

a plurality of dimple portions for engaging said conduits and providing spacing between laterally adjacent vertical arrays, wherein said saddle portions and said dimples are positioned in staggered vertical levels with respect to one another on opposed sides of said ribs; and a plurality horizontal channels where portions of said partition have been removed, said channels being vertically spaced apart from one another and extending horizontally between said saddles.

12. The evaporative apparatus according to claim 11, wherein said vertical partition contacts said conduits at said saddle and said dimple portions.

13. An evaporative apparatus for use in a counter flow heat exchange assembly comprising:

a plurality of generally vertical arrays adjacently spaced laterally to each other, said arrays each arranged along a respective generally vertical centerline and comprising a plurality of generally horizontal conduits each having a diameter and extending across the heat exchange assembly in spaced relation to each other at different vertical levels of the cross flow heat exchange assembly, each said array having connector portions for connecting vertically adjacent conduits to each other, and adjacent ones of said vertical arrays having a centerline-to-centerline distance there between that is greater than the diameter of each said conduit; and a plurality of generally vertical partitions each extending between at least some conduits of each array, wherein the vertical spacing between said conduits within said arrays ranges from about 200% of said conduit diameter to about 1000% said conduit diameter.

14. The evaporative apparatus according to claim 13, wherein the vertical spacing between said conduits within said arrays is 530% the diameter of said conduits.

15. An evaporative apparatus for use in a counter flow heat exchange assembly comprising:

a plurality of generally vertical arrays adjacently spaced laterally to each other, said arrays each arranged along a respective generally vertical centerline and comprising a plurality of generally horizontal conduits each having a diameter and extending across the heat exchange assembly in spaced relation to each other at different vertical levels of the cross flow heat exchange assembly, each said array having connector portions for connecting vertically adjacent conduits to each other, and adjacent ones of said vertical arrays having a centerline-to-centerline distance there between that is greater than the diameter of each said conduit; and a plurality of generally vertical partitions each extending between at least some conduits of each array, wherein the lateral spacing between said conduits of adjacent arrays ranges from about 110% of said conduit diameter to about 150% of said conduit diameter.

16. The evaporative apparatus according to claim 15, wherein the lateral spacing between conduits of adjacent arrays is 130% of said conduit diameter.

17. The evaporative apparatus according to claim 16, wherein said conduits of adjacent arrays are staggered vertically with respect to each other.

18. A method for exchanging heat comprising:

providing a heat exchange assembly having a plurality of generally vertical arrays adjacently spaced laterally to each other, the arrays each arranged along a respective, generally vertical centerline and the arrays each comprising a plurality of generally horizontal conduits extending across the heat exchange assembly in spaced relation to each other at different vertical levels of the heat exchange assembly, each array having connector portions for connecting vertically adjacent conduits to each other;

providing a plurality of generally vertical partitions each extending between at least some conduits of each array, and adjacent ones of the vertical arrays have a centerline-to-centerline distance therebetween that is greater than the diameter of each said conduit;

flowing a substance to be cooled through the conduits;

spraying a fluid onto the vertical partitions and outer surfaces of the conduits; and passing air over the individual conduits, wherein the vertical spacing between the conduits within the arrays ranges from about 200% of the conduit diameter to about 1000% the conduit diameter.

19. The method according to claim 18, wherein the vertical spacing between the conduits within the arrays is 530% the diameter of the conduits.

20. The method according to claim 18, wherein the lateral spacing between the conduits of adjacent arrays ranges from about 120% of the conduit diameter to about 180% of the conduit diameter.

21. The method according to claim 20, wherein the lateral spacing between the conduits of adjacent arrays is 130% of the conduit diameter.

22. A partition for a heat exchanging apparatus having conduits in generally vertical arrays, the partition comprising:

a plurality of saddle portions for engaging said conduits;

a plurality of dimple portions for engaging said conduits and providing spacing between laterally adjacent vertical arrays, wherein said saddle portions and said dimples are positioned in staggered vertical levels with respect to one another on opposed sides of said ribs; and a plurality horizontal channels where portions of said partition have been removed, said channels being vertically spaced apart from one another and extending horizontally between said saddles.

23. A partition according to claim 22, further comprising a plurality of rib portions spaced from one another that extend at least part of the vertical length of said partition.

24. A partition according to claim 23, wherein said vertical partition contacts the conduits at said saddle and said dimple portions.

25. A partition according to claim 23, wherein said partition has at least one corrugated region.

26. An evaporative apparatus for use in a counter flow heat exchange assembly comprising:

a plurality of generally vertical arrays adjacently spaced laterally to each other, said arrays each arranged along a respective generally vertical centerline and comprising a plurality of generally horizontal conduits constructed from a first material, each conduit having a diameter and extending across the heat exchange assembly in spaced relation to each other at different vertical levels of the cross flow heat exchange assembly, each said array having connector portions for connecting vertically adjacent conduits to each other, and adjacent ones of said vertical arrays having a centerline-to-centerline distance there between that is greater than the diameter of each said conduit; and a plurality of generally vertical partitions constructed from a second material different from said first material, each generally vertical partition extending between at least some conduits of each array.

27. The evaporative apparatus according to claim 26, wherein said first material is copper alloy and said second material is polyvinyl chloride (PVC).

28. An evaporative apparatus for use in a counter flow heat exchange assembly comprising:

a plurality of generally vertical arrays adjacently spaced laterally to each other, said arrays each arranged along a respective generally vertical centerline and comprising a plurality of generally horizontal conduits each having a diameter and extending across the heat exchange assembly in spaced relation to each other at different vertical levels of the cross flow heat exchange assembly, each said array having connector portions for connecting vertically adjacent conduits to each other, and adjacent ones of said vertical arrays having a centerline-to-centerline distance there between that is greater than the diameter of each said conduit; and a plurality of generally vertical, single-ply partitions, each generally vertical, single-ply partition extending between at least some conduits of each array.

29. The evaporative apparatus according to claim 28, further comprising a gap that extends between said single-ply partitions and said conduits.

30. The evaporative apparatus according to claim 28, wherein said partitions are each comprised of a sheet-like component separate from said conduits.

* * * * *